US009801412B2

(12) United States Patent
Grant

(10) Patent No.: US 9,801,412 B2
(45) Date of Patent: Oct. 31, 2017

(54) SMOKING ARTICLE WITH DUAL FUNCTION CAP

(71) Applicant: Philip Morris Products S.A., Neuchatel (CH)

(72) Inventor: Christopher John Grant, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 63 days.

(21) Appl. No.: 14/370,546

(22) PCT Filed: Jan. 8, 2013

(86) PCT No.: PCT/EP2013/050210
§ 371 (c)(1),
(2) Date: Jul. 3, 2014

(87) PCT Pub. No.: WO2013/104616
PCT Pub. Date: Jul. 18, 2013

(65) Prior Publication Data

US 2015/0027458 A1 Jan. 29, 2015

(30) Foreign Application Priority Data

Jan. 9, 2012 (EP) ..... 12150518

(51) Int. Cl.
*A24F 13/18* (2006.01)
*A24D 1/04* (2006.01)
(Continued)

(52) U.S. Cl.
CPC ..... *A24F 13/18* (2013.01); *A24D 1/04* (2013.01); *A24D 1/042* (2013.01); *A24D 3/18* (2013.01); *A24F 7/04* (2013.01)

(58) Field of Classification Search
CPC ..... A24F 47/006; A24F 13/18; A24F 7/02; A24F 7/04; A24D 1/042; A24D 3/18
See application file for complete search history.

(56) References Cited

U.S. PATENT DOCUMENTS 2,542,612 A 2/1951 Arneson
3,646,944 A * 3/1972 Banoczi ..... A24F 13/02 131/187

(Continued)

FOREIGN PATENT DOCUMENTS

CA 2 794 337 A1 9/2011
CH 225 017 12/1942

(Continued)

OTHER PUBLICATIONS

Metals—Melting Temperatures, Engineering ToolBox [downloaded online Dec. 14, 2016.*

(Continued)

*Primary Examiner* — Anthony Calandra
(74) *Attorney, Agent, or Firm* — Oblon, McClelland, Maier & Neustadt, L.L.P.

(57) ABSTRACT

A smoking article is formed from two component parts. These parts are a rod comprising an aerosol-forming substrate and a removable cap. The removable cap can be coupled to the rod in two configurations. In a first configuration, the removable cap is coupled to a first end of the rod and a heat source located at or near a second end of the rod heats the aerosol-forming substrate to generate an inhalable aerosol. In a second configuration, the removable cap is coupled to the second end of the rod and at least substantially covers the heat source. The smoking article is arranged in the second configuration for disposal.

8 Claims, 2 Drawing Sheets

(51) Int. Cl.
*A24D 3/18* (2006.01)
*A24F 7/04* (2006.01)

(56) References Cited

U.S. PATENT DOCUMENTS

| | | | | |
|---|---|---|---|---|
| 4,854,332 | A * | 8/1989 | Hanakura | A24D 1/025 131/270 |
| 5,040,552 | A | 8/1991 | Schleich et al. | |
| 5,076,296 | A | 12/1991 | Nystrom et al. | |
| 5,595,577 | A | 1/1997 | Bensalem et al. | |
| 5,918,736 | A * | 7/1999 | Suzuki | A24F 13/18 131/235.1 |
| 2004/0050396 | A1 | 3/2004 | Squeo | |
| 2006/0102188 | A1* | 5/2006 | Grzonka | A24D 3/04 131/365 |
| 2009/0065011 | A1 | 3/2009 | Maeder et al. | |
| 2013/0061861 | A1* | 3/2013 | Hearn | A24F 47/006 131/329 |

FOREIGN PATENT DOCUMENTS

| | | | | |
|---|---|---|---|---|
| CH | 394 680 | | 6/1965 | |
| CN | 201248363 | Y | 6/2009 | |
| CN | 101778578 | A | 7/2010 | |
| DE | 20 2010 008 386 | U1 | 12/2010 | |
| EP | 0 054 718 | | 6/1982 | |
| EP | 0 601 644 | | 6/1994 | |
| GB | 610225 | A * | 10/1948 | A24F 13/02 |
| GB | 2 184 637 | A | 7/1987 | |
| JP | 48-111307 | | 3/1972 | |
| JP | 53-20333 | | 7/1976 | |
| WO | 2004/026052 | | 4/2004 | |
| WO | WO 2007/012007 | A2 | 1/2007 | |
| WO | WO 2007/119678 | A1 | 10/2007 | |
| WO | WO 2009/022232 | A2 | 2/2009 | |

OTHER PUBLICATIONS

Singaporean Office Action dated Oct. 29, 2015 in Patent Application No. 11201403941V.

Extended European Search Report dated Jul. 11, 2012 in the corresponding European Application No. 12150518.4.

International Search Report dated Jun. 19, 2013 in PCT/EP13/050210 filed Jan. 8, 2013.

Written Opinion dated Apr. 16, 2015 in Singapore Patent Application No. 11201403941V.

Australian Office Action dated Oct. 31, 2016 in Patent Application No. 2013209060.

Combined Office Action and Search Report dated Sep. 20, 2016 in Taiwanese Patent Application No. 102100646 (with English translation).

Chinese Office Action with English language translation dated Feb. 6, 2017 in the corresponding Chinese Patent Application No. 2013800050919.9 (18 pages).

Japanese Office Action with English translation dated Nov. 28, 2016 in corresponding Japanese Patent Application No. 2014-551594, citing documents AO-AQ therein (8 pages).

* cited by examiner

SMOKING ARTICLE WITH DUAL FUNCTION CAP

CROSS REFERENCE TO RELATED APPLICATION

This application is a national phase application based on PCT/EP2013/050210, filed on Jan. 8, 2013.

The present specification relates to a smoking article comprising a cap that can act as a mouthpiece for the smoking article during consumption of the smoking article, and can be transferred to the lit end of the smoking article to shield and extinguish the lit end for disposal.

Known smoking articles, such as conventional lit-end cigarettes, may combust or pyrolyse a smokable material, typically tobacco, to generate an inhalable aerosol. Temperatures in the burning tobacco can reach up to about 900 degrees Celsius. Once the cigarette has been consumed, its lit end is generally extinguished by stubbing out the burning tobacco.

Smoking articles in which tobacco is heated rather than combusted are also known in the art. An aim of such heated smoking articles is to reduce known harmful smoke constituents produced by the combustion and pyrolytic degradation of tobacco, as found in conventional lit-end cigarettes. In heated smoking articles, an aerosol is generated by heating a substrate that releases volatile compounds, such as a flavour-generating substrate or aerosol-forming substrate, for example a substrate comprising tobacco. Known heated smoking articles include, for example, smoking articles in which an aerosol is generated by the transfer of heat from a combustible fuel element or heat source to a physically separate aerosol-forming substrate. The aerosol-forming substrate may be located within, around or downstream of the heat source. During smoking, volatile compounds are released from the aerosol-forming substrate by heat transfer from the heat source and entrained in air drawn through the smoking article. As the volatile compounds cool, they condense to form an aerosol that is inhaled by the consumer.

One particular category of heated smoking articles are distillation-based smoking articles. For example, WO-A-2009/022232 discloses a distillation-based smoking article comprising a combustible heat source, an aerosol-forming substrate downstream of the combustible heat source and a heat-conducting element around and in contact with a rear portion of the combustible heat source and an adjacent front portion of the aerosol-forming substrate.

During use of a heated smoking article, its heat source may reach high temperatures. For example, a heat source of a heated smoking article may reach an average temperature of around 500° Celsius and in certain cases the temperature of the heat source may reach up to about 800° Celsius.

After use, both conventional lit-end cigarettes and heated smoking articles comprising a heat source, for example a heat sink, a chemical heat source or a combustible heat source, should be properly extinguished or shielded to allow sufficient cooling to facilitate disposal.

It is an object of the present invention to provide a means suitable for facilitating disposal of a smoking article after use. Advantageously, such means has dual functionality and is suitable to serve as both a mouthpiece during use and as a means for facilitating disposal after use.

As used herein, the terms 'aerosol-generating article' or 'smoking article' refer to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable. The term 'smoking article' is generally used hereafter.

A smoking article may be a heated smoking article, which is a smoking article comprising an aerosol-forming substrate that is intended to be heated rather than combusted in order to release volatile compounds that can form an aerosol. The aerosol formed by heating the aerosol-forming substrate may contain fewer known harmful constituents than would be produced by combustion or pyrolytic degradation of the aerosol-forming substrate. A smoking article may be a combustible smoking article, which is a smoking article that releases an aerosol by direct combustion of an aerosol-forming substrate, for example as in a conventional cigarette. A heated smoking article may comprise a combustible heat source that heats the aerosol-forming substrate.

The term 'combustible heat source' refers to a combustible material that is physically separate from the aerosol-forming substrate in a heated smoking article. The combustible heat source may be a carbon based material that can be combusted, and which upon combustion heats an aerosol-forming substrate without combusting the aerosol-forming substrate.

As used herein, the term 'aerosol-forming substrate' relates to a substrate capable of releasing volatile compounds that can form an aerosol. Such volatile compounds may be released by heating the aerosol-forming substrate. An aerosol-forming substrate may be solid or liquid or comprise both solid and liquid components. An aerosol-forming substrate may be adsorbed, coated, impregnated or otherwise loaded onto a carrier or support. An aerosol-forming substrate may conveniently be part of an aerosol-generating article or smoking article.

An aerosol-forming substrate may comprise nicotine. An aerosol-forming substrate may comprise tobacco, for example it may comprise a tobacco-containing material containing volatile tobacco flavour compounds, which are released from the aerosol-forming substrate upon heating. In preferred embodiments, an aerosol-forming substrate may comprise homogenised tobacco material, for example cast leaf tobacco. An aerosol-forming substrate may comprise at least one aerosol-former, such as propylene glycol or glycerine. In a combustible smoking article, an aerosol-forming substrate may be conventional tobacco. A smoking article may be, or may comprise, a tobacco stick.

According to one aspect of the invention there is provided a smoking article comprising: a rod, having a first end and a second end; and a removable cap. The cap is removably couplable to both the first end and the second end of the rod. In a first configuration of the smoking article, the removable cap is coupled to the first end of the rod such that air may be drawn from the rod through the removable cap. In a second configuration of the smoking article, the removable cap is coupled to the second end of the rod such that the second end is at least substantially covered by the removable cap. In the second configuration, the cap facilitates disposal of the smoking article after use.

The term "removably couplable" is used herein to mean that the removable cap is capable of being detachably secured to the first end and the second end of the rod of the smoking article. The removable cap may be removably couplable to one or both of the first end and the second end of the rod by mechanical fastening means (for example, a screw fit, bayonet coupling, hook and loop fastening, etc.) or by non-mechanical fastening means (for example, a non-permanent adhesive) or by a combination of mechanical fastening means and non-mechanical fastening means. Preferably, the removable cap is removably couplable to one or both of the first end and the second end of the rod by an interference fit. For example, the removable cap may be removably couplable to one or both of the first end and the second end of the rod by an interference fit between an outer surface of the rod and an inner surface of the removable cap.

In the second configuration of the smoking article, the removable cap preferably at least substantially covers the second end of the rod so as to facilitate disposal of the smoking article.

The removable cap may comprise one or more materials that thermally shield the second end of the rod. Alternatively or in addition, the removable cap may comprise one or more materials that in other ways limit energy transfer from a heat source located at or proximate to the second end of the rod. Preferably, when coupled to the second end of the rod, the removable cap lowers the ignition propensity of the smoking article upon disposal, thus facilitating disposal of the smoking article after use. In some embodiments, when coupled to the second end of the rod, the removable cap lowers the temperature of the second end of the rod such that the smoking article is comfortable to touch and thereby facilitates disposal of the smoking article after use.

In some embodiments, the removable cap may comprise means to dissipate heat energy from a heat source located at or proximate to the second end of the rod. For example, the removable cap may comprise one or more thermally conductive materials for dissipating heat energy by thermal conduction.

In some embodiments, the removable cap may comprise means to thermally insulate a heat source located at or proximate to the second end of the rod from the environment. For example, the removable cap may comprise one or more thermally insulating materials that act as a thermal barrier to prevent heat energy transfer from a heat source located at or proximate to the second end of the rod. Suitable thermally insulating materials have a low thermal conductivity or substantially no thermal conductivity.

In some embodiments, the removable cap may comprise a combination of heat dissipating means and thermally insulating means.

The first end of the rod may be termed a mouth end of the rod, as it is the end of the rod closest to a user's mouth when the smoking article is being consumed. The second end of the rod may be termed a distal end of the rod, and is located at the opposite end of the rod to the mouth end.

It may be an advantage that the removable cap is able to function as a mouthpiece of the smoking article by being coupled to the mouth end of the rod in the first configuration of the smoking article. When the removable cap is coupled to the mouth end of the rod in the first configuration of the smoking article, a user does not need to search for a separate additional component or part to couple to the second end of the rod upon disposal of the smoking article.

The outer surface of the removable cap is preferably made from one or more materials that is acceptable to consumer touch and conforms to any applicable regulatory requirements when the removable cap is used as a mouthpiece of the smoking article.

In preferred embodiments, the smoking article comprises a combustible heat source located at or proximate to the second end of the rod. In such embodiments in the second configuration of the smoking article, the removable cap at least substantially covers the heat source and significantly reduces or eliminates any potential ignition risk posed by the heat source. Preferably, the removable cap encloses and extinguishes the heat source, for example by eliminating or restricting oxygen supply to the heat source.

Preferably, in the second configuration, the ignition propensity of the smoking article is sufficiently low that the smoking article may be disposed of without risk of causing a fire. In the second configuration, the removable cap may lower the temperature of the second end of the rod sufficiently that the smoking article is comfortable to touch.

In embodiments of smoking articles that are heated smoking articles in which heat is generated through combustion of a solid heat source, the heat source may comprise any suitable combustible fuel including, but not limited to, carbon and carbon-based materials containing aluminium, magnesium, one or more carbides, one or more nitrides and combinations thereof. Solid combustible heat sources for heated smoking articles and methods for producing such heat sources are known in the art and described in, for example, U.S. Pat. No. 5,040,552 and U.S. Pat. No. 5,595,577. Typically, known solid combustible heat sources for heated smoking articles are carbon-based, that is they comprise carbon as a primary combustible material.

In embodiments of smoking articles that are conventional lit-end cigarettes, the heat source will be a volume of tobacco.

By covering the heat source with the removable cap while the heat source is combusting or hot, a barrier is formed that may help prevent the heat source from igniting materials adjacent to the heat source. Thus, the heat source may be shielded by the removable cap until it has cooled to a sufficiently low temperature to significantly reduce or eliminate any potential risk associated with improper handling of the smoking article, such as the potential risk of igniting adjacent materials. In order to act as a barrier, the removable cap may comprise one or more suitable barrier materials that act to insulate the heat source.

A suitable barrier material may be a substantially non-combustible material or a substantially flame retardant material. Preferably, the barrier material is thermally stable in air at the highest temperature achieved by the heat source of the smoking article. Suitable barrier materials may, for example, include metallic materials, or ceramic materials.

A smoking article may remain alight for a period of about 4 minutes to about 8 minutes before it has expended its combustible material. While the heat source cools down or while remaining combustible material is burned, formation of hot spots on the removable cap should be avoided. To reduce or prevent the formation of hot spots on the cap it may be advantageous to spread any heat energy remaining in the heat source after consumption of the smoking article over a wide area. Thus, in some embodiments, the removable cap may comprise a thermally conductive material that can efficiently spread thermal energy from a heat source over a wide area by thermal conduction. Suitable thermally conductive materials may, for example, include metallic foils or graphite sheets, or other materials that have a high thermal conductivity.

It may be advantageous that the removable cap comprises one or more thermal barrier materials that act to thermally isolate the heat source once the removable cap has been coupled to the second end of the rod. A thermal barrier material may help prevent transfer of heat from the heat source to an outer surface of the smoking article and to the external environment. Thus, in some embodiments, the removable cap may comprise, for example, a thermally insulating material to thermally isolate the heat source. Suitable thermally insulating materials may include, for example, cardboards, foams, polymers or ceramic materials, or other materials that have a low thermal conductivity.

The removable cap may comprise one or more materials that undergo a phase change when heated, for example, when the removable cap is coupled to the second end of the rod. The removable cap may comprise one or more materials that melt and extinguish the heat source by flowing over the heat source and eliminating or restricting oxygen supply to the heat source. The removable cap may comprise one or more materials that undergo an endothermic reaction or phase change and consume heat energy produced by the heat source, thereby cooling the heat source. The removable cap may comprise one or more materials that decompose when brought in contact with the heat source and produce a decomposition product that extinguishes the heat source. Examples of materials that may undergo a phase change when in proximity to the heat source include, for example, certain polymers and waxes.

The removable cap may comprise one or more materials selected from the group consisting of barrier materials, non-combustible materials, flame retardant materials, thermally conductive materials, thermally insulating materials, foam materials, phase-changing materials, metallic materials, and ceramic materials. For example, the removable cap may comprise one or more materials selected from the group consisting of non-combustible materials, flame-retardant materials, thermally conductive materials and thermally insulating materials.

In some embodiments, the removable cap may comprise a combination of different materials. For example, the removable cap may comprise a flame-retardant material, a thermally conductive material and a thermally insulating material all disposed as separate layers of the removable cap.

The removable cap may define a sheath for receiving a rod. In some embodiments, the removable cap may comprise a tubular sheath, the tubular sheath being dimensioned to receive both the first end and the second end of the rod to enable the removable cap to be coupled to either the first end or the second end of the rod. For example, the smoking article may comprise a substantially cylindrical rod and the removable cap may comprise a substantially tubular sheath dimensioned to receive either end of the rod. In other words, the sheath is dimensioned to receive the first end of the rod and the second end of the rod. Preferably, the sheath forms a tight interference fit when coupled with the first end and the second end of the rod.

In some embodiments, the sheath may be formed from, or lined with, one or more materials selected from the group consisting of barrier materials, non-combustible materials, flame retardant materials, thermally conductive materials, thermally insulating materials, foam materials, phase-changing materials, metallic materials, and ceramic materials. For example, the tubular sheath may be formed from, or lined with, one or more materials selected from the group consisting of aluminium foil, graphite, phase-changing materials, and foams.

In some preferred embodiments, the sheath may be lined with a layer of metallic foil, for example aluminium foil. In some embodiments, the sheath may be lined with a layer of polymeric foam that acts as a thermal barrier to the passage of heat from a heat source.

In some embodiments, the sheath may be lined with a layer of metallic foil that acts as both a flame retardant material to isolate a heat source and as a thermally conductive material to spread thermal energy to rapidly dissipate heat from the heat source and prevent the formation of hot spots. The sheath may also be lined with a layer of a thermally insulating material such as cardboard or polymeric foam, to act as a thermal barrier. In such embodiments, it is preferred that the layer of metallic foil forms an inner layer in contact with the rod when the removable cap is coupled to the rod. Thus, in the second configuration of the smoking article, the layer of metallic foil may act to shield the thermally insulating material from direct contact with a heat source. In this way, combustible materials in the thermally insulating material may be shielded sufficiently from the heat source to be used as thermal barrier materials in the removable cap.

In some embodiments, the sheath may comprise a combination of different materials. For example, the sheath may comprise a flame-retardant material, a thermally conductive material and a thermally insulating material all disposed as separate layers of the sheath.

In some embodiments, the removable cap may comprise one or more thermochromatic pigments or materials that change colour with respect to temperature. This has the advantage of providing a user with a visual warning to take care when handling the smoking article. Furthermore, the use of a thermochromatic pigment or material may provide a simple visual indication of when the smoking article has reached a temperature that is low enough to be disposed of without additional precautionary measures.

In some embodiments, a portion of the removable cap may be formed from one or more thermochromatic materials, for example from a thermochromatic polymer. In some embodiments, the removable cap may be wrapped in a wrapping paper that comprises one or more thermochromatic pigments.

In some embodiments, a thermochromatic pigment or material may be included in a portion of the removable cap so as to avoid or limit potential contact between the thermochromatic pigment or material and a user's lips when the removable cap is used as a mouthpiece. If a thermochromatic pigment or material is included in a portion of the removable cap that allows potential contact between the thermochromatic pigment or material and a user's lips when the removable cap is used as a mouthpiece, the included thermochromatic pigment or material is preferably for oral use.

Preferably, the removable cap acts to enclose the second end of the rod in the second configuration of the smoking article. This may help to eliminate or restrict oxygen supply to the heat source. This may also help to retain any ash or unpleasant odours at the second end of the rod.

In some embodiments, the rod comprises a tobacco-containing material.

Preferably, the smoking article comprises an aerosol-forming substrate. In preferred embodiments, a combustible heat source is located at or near the second end of the rod, and the rod comprises an aerosol-forming substrate located between its first end and second end.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise one or more aerosol formers. Examples of suitable aerosol formers include, but are not limited to, glycerine and propylene glycol.

If the aerosol-forming substrate is a solid aerosol-forming substrate, the solid aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug, including any wrapper, is considered to be the aerosol-forming substrate.

Optionally, the solid aerosol-forming substrate may contain additional tobacco or non-tobacco volatile flavour compounds, to be released upon heating of the solid aerosol-forming substrate. The solid aerosol-forming substrate may also contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghetti strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The smoking article may comprise a transfer section or transfer element. Such an element may take the form of a hollow tube that is located downstream of an aerosol-forming substrate within the rod.

The terms "upstream" and "downstream" as used herein refer to relative positions along a smoking article defined with reference to the direction in which air is drawn through the smoking article by a user. Thus, the first end, or mouth end, is downstream from the second end, or distal end.

Elements forming the rod of the smoking are preferably assembled by means of a suitable wrapper, for example a cigarette paper. A cigarette paper may be any suitable material for wrapping components of a smoking article in the form of a rod. The cigarette paper needs to grip the component elements of the smoking article when the article is assembled and hold them in position within the rod. Suitable materials are well known in the art.

The smoking article may be substantially cylindrical in shape. The smoking article may be substantially elongate. The smoking article may have a length and a circumference substantially perpendicular to the length.

The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be located in the smoking article such that the length of the aerosol-forming substrate is substantially parallel to the airflow direction in the smoking article.

The transfer section or element may be substantially elongate.

The smoking article may have any desired length. For example, the smoking article may have a total length of between approximately 65 mm and approximately 100 mm when the rod and the removable cap are coupled.

The smoking article may have any desired external diameter. For example, the smoking article may have an external diameter of between approximately 5 mm and approximately 12 mm.

The removable cap may comprise a filter. Where the removable cap comprises a filter, the filter is preferably positioned such that, when the removable cap is coupled to the first end of the rod in the first configuration, air may be withdrawn from the rod through the filter.

For example, the removable cap may comprise a filter plug having one or more segments. Where the removable cap comprises a filter plug, preferably the filter plug is a single segment filter plug. In some embodiments, removable cap may comprise a filter plug that is located at the downstream end of the removable cap when the removable cap is coupled to the first end of the rod in the first configuration of the smoking article.

The filter plug may comprise one or more segments comprising cellulose acetate, paper or other suitable known filtration materials, or combinations thereof. Preferably, the filter plug comprises filtration material of low filtration efficiency. Any filtration material included in the removable cap should not compromise the functionality of the removable cap when coupled to the second end of the rod in the second configuration.

The removable cap may be circumscribed by an outer wrapper of, for example, cigarette paper, which has low air permeability. Alternatively or in addition, the removable cap may be circumscribed by tipping paper.

According to a further aspect of the invention there is provided a removable cap for a smoking article. The cap is removably couplable to both a first end and a second end of a rod comprising an aerosol-forming substrate to form the smoking article. The cap is configured such that when coupled to the first end of the rod air may be drawn from the rod through the cap, and when coupled to the second end of the rod the cap facilitates disposal of the smoking article after use of the smoking article.

The removable cap preferably lowers the ignition propensity of the smoking article when coupled to the second end of the rod.

The second end is at least substantially covered by the removable cap when the cap is coupled to the second end of the rod.

The removable cap may comprise one or more materials selected from the group consisting of barrier materials, non-combustible materials, flame retardant materials, thermally conductive materials, thermally insulating materials, foam materials, phase-changing materials, metallic materials, and ceramic materials. For example, the removable cap may comprise one or more materials selected from the group consisting of non-combustible materials, flame-retardant materials, thermally conductive materials and thermally insulating materials.

In preferred embodiments, the removable cap comprises a tubular sheath. The tubular sheath is dimensioned to receive both the first end and the second end of the rod to enable the removable cap to be coupled to either the first end or the second end of the rod.

The tubular may be formed from, or lined with, one or more materials selected from the group consisting of aluminium foil, graphite, phase-changing materials, and foams.

The removable cap is preferably a component part of a smoking article. The removable cap may form a component part of any smoking article as described herein.

According to another aspect of the invention there is provided use of a removable cap according to the invention as a mouthpiece when coupled to a first end of a rod comprising an aerosol-forming substrate, and as a means to facilitate disposal of the rod when coupled to a second end of the rod after use.

According to another aspect of the invention there is provided a smoking system or kit comprising a plurality of rods and one or more removable caps. The rods may be coupled to a removable cap to form smoking articles.

In preferred embodiments, a combustible heat source is located at or near the second end of each of the rods, and each of the rods comprises an aerosol-forming substrate located between its first end and second end.

According to another aspect of the invention there is provided a method of using a smoking article comprising a rod having a first end and a second end and a removable cap coupled to the first end of the rod. The method comprises the steps of, applying a source of heat to the second end of the rod, drawing air from the rod through the removable cap, removing the removable cap from the first end of the rod, and coupling the removable cap to the second end of the rod such that the second end of the rod is at least substantially covered by the removable cap.

Preferably, the step of applying a source of heat to the second end of the rod involves igniting a combustible heat source located at or proximate to the second end of the rod.

Preferably, the step of coupling the removable cap to the second end of the rod at least substantially covers the heat source, and preferably extinguishes any ignited material at the second end of the rod.

The method may be used with any smoking article or removable cap as described herein.

According to another aspect of the invention there is provided a method of facilitating disposal of a smoking article comprising a rod comprising a heat source and an aerosol-forming substrate after use. The method comprises providing a removable cap that is removably couplable to a first end of the rod such that air may be drawn from the rod through the cap and removably couplable to a second end of the rod such that the heat source is at least substantially covered by the removable cap.

The method may be used with any smoking article or removable cap as described herein.

Features described in relation to one aspect of the invention may also be applicable to other aspects of the invention.

Specific embodiments of the invention will now be described with reference to the figures, in which.

Figure 1:
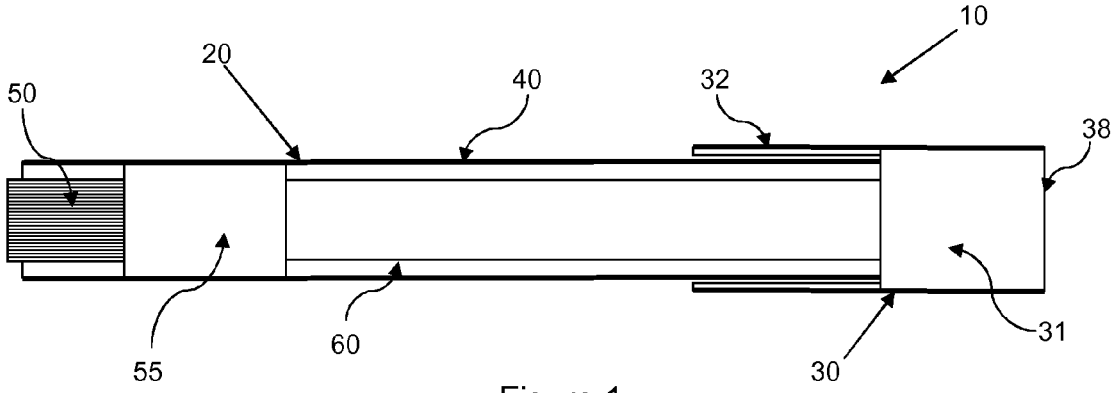
FIG. 1 is a schematic cross-sectional diagram of a first embodiment of a smoking article comprising a rod and a removable cap in a first configuration.
Figure 2:
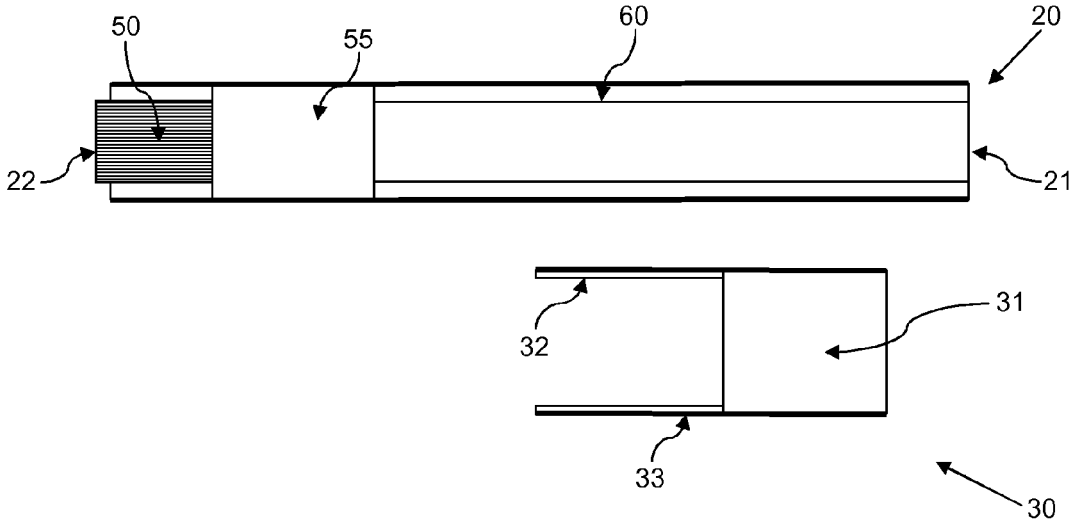
FIG. 2 is a schematic cross-sectional diagram of the smoking article of FIG. 1 in which the rod and the removable cap have been separated.
Figure 3:
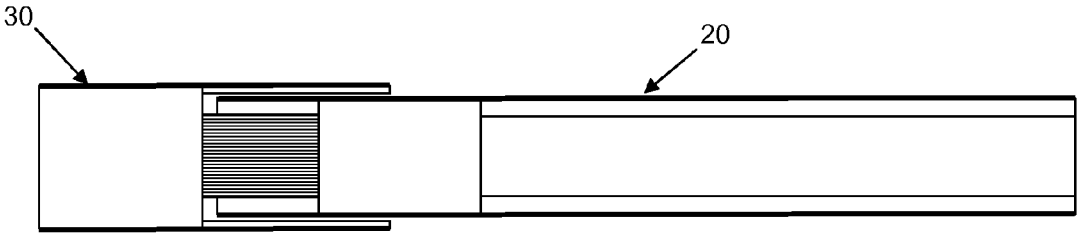
FIG. 3 is a schematic cross-sectional diagram of the smoking article of FIG. 1 in a second configuration.

FIGS. 1, 2, and 3 illustrate a smoking article 10 according to a first embodiment of the invention. The smoking article 10 comprises two separable component parts, a rod 20 and a removable cap 30. The rod 20 has a first end or mouth end 21 and a second end or distal end 22.

The removable cap 30 can be coupled to the rod 20 in a first configuration in which the removable cap 30 is coupled to the mouth end 21 of the rod 20, as illustrated in FIG. 1. The removable cap 30 can be coupled to the rod 20 in a second configuration in which the removable cap 30 is coupled to the distal end 22 of the rod 20, as illustrated in FIG. 3.

The rod 20 comprises three elements circumscribed by a cigarette paper 40. The three elements are a combustible heat source 50, an aerosol-forming substrate 55, and a transfer element 60. These three elements are arranged sequentially and in coaxial alignment and are assembled by the cigarette paper 40 to form the rod 20.

When assembled, the rod 20 is between about 65 millimeters and about 90 millimeters in length and has an external diameter of between about 7.2 millimeters and about 7.9 millimeters.

The aerosol-forming substrate 55 is located upstream of the transfer element 60. The aerosol-forming substrate 55 comprises tobacco wrapped in a filter paper (not shown) to form a plug. The tobacco includes additives, including glycerine as an aerosol-forming additive.

The combustible heat source 50 is located upstream of, and in contact with, the aerosol-forming substrate 55. In alternative embodiments (not shown), a thermally conductive element, such as a metal foil, may be disposed circumferentially around a portion of the combustible heat source and a portion of the aerosol-forming substrate to facilitate the transfer of heat from the combustible heat source to the aerosol-forming substrate.

The transfer element 60 is a hollow tube formed from filter paper. The transfer element 60 receives volatile compounds evolved from the aerosol-forming substrate 55 and allows these compounds to condense to form an aerosol. The transfer element 60 also facilitates transfer of the aerosol towards a user's mouth and provides the rod 20 with a suitable length.

The removable cap 30 comprises a filter 31 and a tubular sheath 32 circumscribed by a filter paper 33. The filter 31 is a conventional mouthpiece filter formed from cellulose acetate, and having a length between about 7 millimeters and about 10 millimeters. The removable cap 30 may be circumscribed by tipping paper (not shown).

Figure 4:
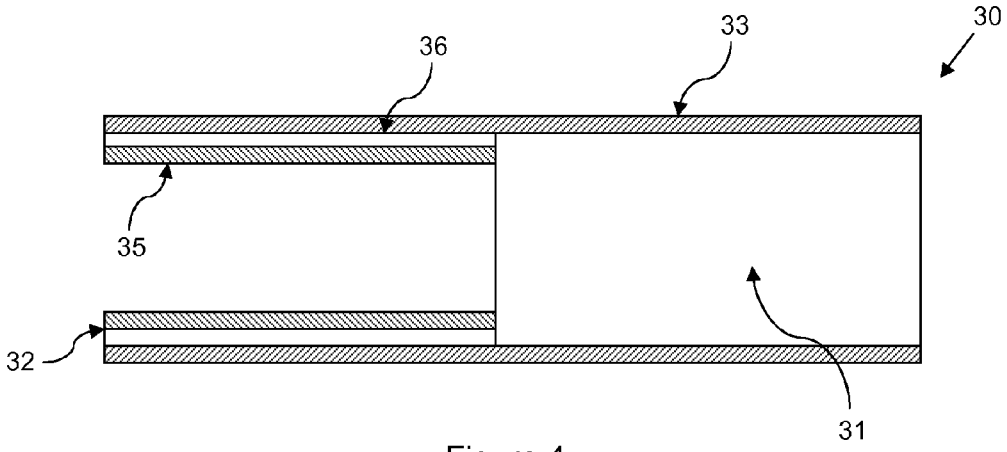
FIG. 4 is a schematic cross-sectional diagram of the removable cap of the smoking article of FIG. 1.

The structure of the removable cap 30 is shown in greater detail in FIG. 4. The tubular sheath 32 consists of an inner tube 35 formed from aluminium foil having a thickness of about 20 microns. An outer tube 36 is disposed concentrically outside the inner tube 35 and is formed from cardboard having a thickness of about 0.2 mm. The sheath 32 abuts a face of the filter 31 and the two elements are circumscribed by the filter paper 33.

In a first configuration of the smoking article, the removable cap 30 is coupled to the mouth end 21 of the rod 20, as illustrated in FIG. 1. In the first configuration, the mouth end 21 of the rod 20 is received within the tubular sheath 32 of the removable cap 30 to form the smoking article. The removable cap 30 and the rod 20 are maintained in the first configuration by an interference fit between an outer surface of the rod 20 and an inner surface of the tubular sheath 32.

To consume the smoking article, a user ignites the combustible heat source 50 and then draws air through the smoking article 10 by drawing on a mouth end 38 of the removable cap 30. The temperature in the heat source 50 rises and thermal energy passes to the aerosol-forming substrate 55 by processes such as conduction and convection. An aerosol generated from the aerosol-forming substrate passes along the transfer element 60, through the filter 31, and is inhaled by the user.

The user repeatedly draws or puffs on the smoking article and consumes the aerosol generated from the aerosol-forming substrate 55.

When the smoking article has been consumed, the removable cap 30 is separated from the rod 20 by sliding the rod 20 out of the tubular sheath 32, as illustrated in FIG. 2.

The removable cap 30 is then coupled to the distal end 22 of the rod 20 in a second configuration of the smoking article 10, as illustrated in FIG. 3. In the second configuration, the distal end 22 of the rod 20 is received within the tubular sheath 32 of the removable cap 30 and the distal end 22 of the rod 20 is covered by the removable cap 30.

In the second configuration, a front portion of the combustible heat source 50 may contact the filter 31. Heat energy radiated and conducted from the combustible heat source 50 is spread over the area of the tubular sheath 32 by the thermally conductive aluminium foil inner tube 35 of the tubular sheath 32. This prevents the formation of hot spots on the removable cap 30.

In the second configuration, the thermally insulating outer tube 36 of the tubular sheath 32 of the removable cap 30 insulates an external surface of the smoking article 10 from heat from the combustible heat source 50. In the second configuration, the removable cap 30 facilitates disposal of the smoking article 10. More preferably, the smoking article 10 in the second configuration may be disposed of without significant risk of igniting other materials.

Figure 5:
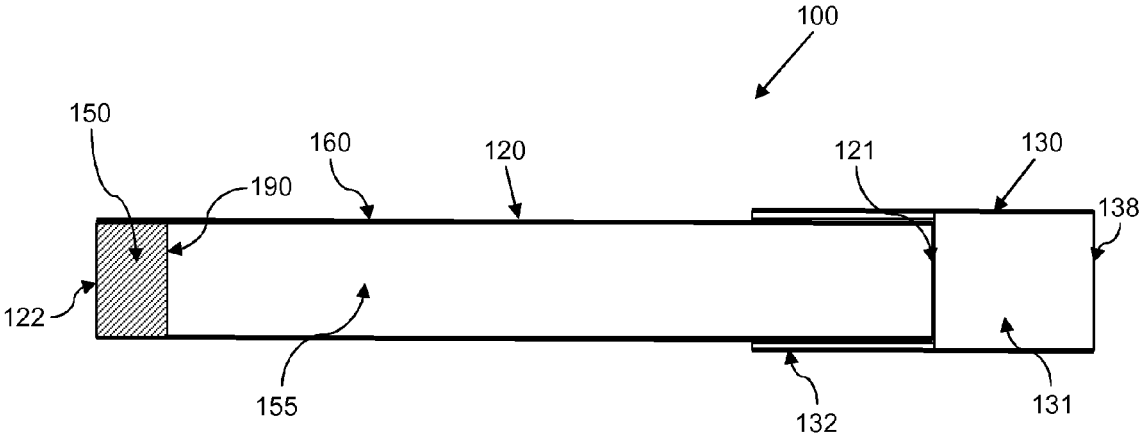
FIG. 5 is a schematic cross-sectional diagram of a second embodiment of a smoking article comprising a rod and a removable cap in a first configuration.
Figure 6:
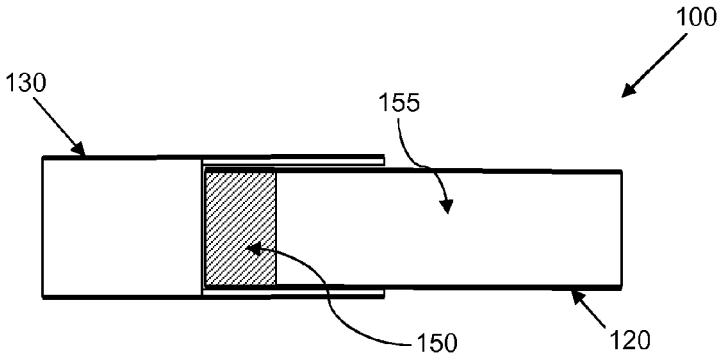
FIG. 6 is a schematic cross-sectional diagram of the smoking article of FIG. 5 in a second configuration.

A second embodiment of a smoking article according to the invention is illustrated in FIGS. 5 and 6. The smoking article 100 of the second specific embodiment comprises two component parts, a rod 120 and a removable cap 130.

The rod 120 comprises an aerosol-forming substrate 155 wrapped in a cigarette paper 160 to form the rod 120. The aerosol-forming substrate 155 is tobacco, and the rod 120 is effectively a conventional filterless cigarette. The rod 120 has a mouth end 121 closest to a user's mouth when the smoking article is being consumed, and a distal end 122 at an opposite end of the rod 120 to the mouth end 121. The removable cap 130 is identical to the removable cap (reference numeral 30) described above in relation to the first embodiment of the invention shown in FIGS. 1 to 4. In a first configuration, the mouth end 121 of the rod 120 is received within the tubular sheath 32 of the removable cap 30 to form the smoking article 100.

To consume the smoking article 100, a user places a mouth end 138 of the removable cap 130 into their mouth. The distal end 122 of the rod 120 is then ignited and the user draws air through the smoking article. A portion of the tobacco 155 at the distal end 122 of the rod 120 combusts and becomes a heat source 150 for forming an inhalable aerosol from the tobacco 155.

The user consumes the smoking article 100 by drawing or puffing on the mouth end 138 of the removable cap 130. An inhalable aerosol is generated within the rod 120, passes through the filter 131 of the removable cap 130 and is inhaled by the user. Each successive puff causes a burning line or char line 190 to move downstream to fresh unburned tobacco 155. Consequently, the rod 120 becomes shorter with each puff.

Once the smoking article 100 has been consumed, the removable cap 120 is removed from the remains of the rod 120. The removable cap 130 is then coupled to the distal end 122 of the rod 120 in a second configuration of the smoking article 100, where it covers the heat source 150, as illustrated in FIG. 6.

As described above, in the second configuration heat energy from the heat source 150 is spread by a thermally conductive layer of the tubular sheath 132. A thermally insulating layer of the tubular sheath 132 acts to prevent a surface of the smoking article from getting too hot. Furthermore, the removable cap 130 may eliminate or restrict oxygen supply to the heat source 150, which may assist in extinguishing the heat source 150. In addition, the removable cap 130 acts as a receptacle for any remaining ash associated with the heat source 150 and lessens the possibility of the ash causing a potential fire risk. The removable cap 130 may also contain any unpleasant odours that may develop from the heat source 150 as it is extinguished.

The exemplary embodiments described above illustrate but do not limit the invention. In view of the above-discussed exemplary embodiments, other embodiments consistent with the above exemplary embodiments will now be apparent to one of ordinary skill in the art.

The invention claimed is:

1. A smoking article, comprising:

a rod having a first end and a second end;

a combustible heat source located at or proximate to the second end of the rod; and a removable cap, the removable cap being removably couplable to both the first end and the second end of the rod, wherein in a first configuration of the smoking article the removable cap is coupled to the first end of the rod such that air may be drawn from the rod through the removable cap, wherein in a second configuration of the smoking article the removable cap is coupled to the second end of the rod such that the second end is at least substantially covered by the removable cap, such that in the second configuration the removable cap facilitates disposal of the smoking article after use, wherein the removable cap comprises a material to thermally isolate the combustible heat source when the removable cap is coupled to the second end of the rod, and wherein the removable cap further comprises one or more materials that, when the removable cap is coupled to the second end of the rod:

undergo decomposition to produce a decomposition product that extinguishes the heat source, or undergo a phase change to consume heat energy produced by the heat source, the one or more phase change materials comprising a polymer, a wax, or both a polymer and a wax.

2. The smoking article according to claim 1, wherein the removable cap comprises a tubular sheath, the tubular sheath being dimensioned to receive both the first end and the second end of the rod to enable the removable cap to be coupled to either the first end or the second end of the rod.

3. The smoking article according to claim 1, in which the rod comprises an aerosol-forming substrate located between its first end and second end.

4. The smoking article according claim 1, in which the rod comprises a tobacco-containing material.

5. The smoking article according to claim 1, in which the removable cap further comprises one or more materials selected from the group consisting of non-combustible materials and flame-retardant materials.

6. The smoking article according to claim 2, in which the tubular sheath is formed from, or lined with, one or more materials selected from the group consisting of aluminium foil, graphite, phase-changing materials, and foams.

7. The smoking article according to claim 1, in which the removable cap comprises a filter positioned such that, when the removable cap is coupled to the first end of the rod in the first configuration, air may be withdrawn from the rod through the filter.

8. The smoking article according to claim 1, in which the removable cap further comprises one or more thermochromatic pigments or materials.

* * * * *